US009180996B2

(12) United States Patent
Mathieu et al.

(10) Patent No.: US 9,180,996 B2
(45) Date of Patent: Nov. 10, 2015

(54) CORRUGATED CARDBOARD BOX WITH OPEN-WORK FLAPS AND SET OF BLANKS FOR OBTAINING SAME

(75) Inventors: Gerard Mathieu, Cergy (FR); Olivier Bourdin, Amiens (FR)

(73) Assignee: Otor, S.A., Paris (FR)

( * ) Notice: Subject to any disclaimer, the term of this patent is extended or adjusted under 35 U.S.C. 154(b) by 510 days.

(21) Appl. No.: 11/922,222

(22) PCT Filed: Jun. 21, 2006

(86) PCT No.: PCT/FR2006/001404

§ 371 (c)(1),
(2), (4) Date: Jun. 9, 2008

(87) PCT Pub. No.: WO2006/136703

PCT Pub. Date: Dec. 28, 2006

(65) Prior Publication Data

US 2008/0245849 A1 Oct. 9, 2008

(30) Foreign Application Priority Data

Jun. 23, 2005 (FR) ..... 05 06415

(51) Int. Cl.
*B65D 5/462* (2006.01)
*B65D 5/16* (2006.01)
(Continued)

(52) U.S. Cl.
CPC *B65D 5/16* (2013.01); *B65D 5/321* (2013.01); *B65D 5/326* (2013.01); *B31B 17/00* (2013.01);
(Continued)

(58) Field of Classification Search
CPC ..... B65D 5/12; B65D 5/16; B65D 5/68; B65D 5/4204; B65D 2519/00333; B65D 2519/00711; B31B 17/00; B31B 2217/068
USPC ..... 229/109, 117.17, 122.3, 122.27, 162.1, 229/162.3, 103.3, 129, 125.32, 162.7; 206/736, 738, 750, 763, 514
See application file for complete search history.

(56) References Cited

U.S. PATENT DOCUMENTS 1,488,533 A 4/1924 Flood
1,865,688 A 7/1932 Hannaford
(Continued)

FOREIGN PATENT DOCUMENTS

DE 89 01 418 3/1989
FR 2 853 886 10/2004
WO WO 03/022693 3/2003

OTHER PUBLICATIONS

U.S. Appl. No. 12/940,275—Non-Final Office Action dated Jan. 18, 2013.
(Continued)

*Primary Examiner* — Christopher Demeree
(74) *Attorney, Agent, or Firm* — Banner & Witcoff, Ltd.

(57) ABSTRACT

The invention concerns a generally parallelepiped corrugated box for packaging and transporting objects, the box comprising a lid formed by a lateral can-band carton including a front wall, a rear wall, and side walls and a top, and a tray forming a base including a central panel comprising four main sides each respectively provided with a first flap. The front and rear flaps are U-shaped and define each with the top a central recess enabling an object in the box to be gripped manually by a user from the side and/or from above. One or several partly precut portions and/or one or several bonding points enable the walls of the lid to be detached from the first flaps of the tray by manual separation resulting from a force applied perpendicularly to the walls.

13 Claims, 9 Drawing Sheets

(51) Int. Cl.

| | |
|---|---|
| ***B65D 5/32*** | (2006.01) |
| *B65D 5/68* | (2006.01) |
| *B31B 17/00* | (2006.01) |
| *B65D 5/12* | (2006.01) |
| *B65D 5/42* | (2006.01) |

(52) U.S. Cl.

CPC ..... *B31B 2217/068* (2013.01); *B65D 5/12* (2013.01); *B65D 5/4204* (2013.01); *B65D 5/68* (2013.01); *B65D 2519/00333* (2013.01); *B65D 2519/00711* (2013.01)

(56) References Cited

U.S. PATENT DOCUMENTS

| | | | | | |
|---|---|---|---|---|---|
| 2,139,626 | A | * | 12/1938 | Sidebotham | 493/82 |
| 2,885,137 | A | * | 5/1959 | Guyer | 229/125.19 |
| 3,342,401 | A | | 9/1967 | Kitchell | |
| 3,633,760 | A | | 1/1972 | Vosbikian | |
| 3,913,300 | A | | 10/1975 | Benzing | |
| 4,117,646 | A | | 10/1978 | James et al. | |
| 4,160,353 | A | | 7/1979 | Ganz | |
| 4,283,188 | A | | 8/1981 | Wingerter et al. | |
| 4,310,323 | A | | 1/1982 | Moen | |
| 4,318,474 | A | * | 3/1982 | Hasegawa | 206/428 |
| 4,596,542 | A | | 6/1986 | Moen | |
| 4,601,687 | A | | 7/1986 | Gallaher | |
| 4,693,411 | A | * | 9/1987 | Snyder | 229/117.02 |
| 4,932,930 | A | | 6/1990 | Coalier et al. | |
| 5,139,194 | A | * | 8/1992 | Youell, Jr. | 229/122.27 |
| 5,398,869 | A | * | 3/1995 | Dickson et al. | 229/162.6 |
| 5,443,205 | A | * | 8/1995 | Robotham et al. | 229/243 |
| 5,579,990 | A | | 12/1996 | Durand | |
| 5,938,108 | A | * | 8/1999 | Williams et al. | 229/109 |
| 5,950,911 | A | * | 9/1999 | Naughton et al. | 229/109 |
| 6,138,903 | A | | 10/2000 | Baker | |
| 6,257,411 | B1 | | 7/2001 | Bacques et al. | |
| 6,264,034 | B1 | | 7/2001 | Bacques et al. | |
| 6,311,891 | B1 | | 11/2001 | Gardner | |
| 6,352,199 | B1 | | 3/2002 | Gardner | |
| 6,520,898 | B1 | | 2/2003 | Moen | |
| 6,619,540 | B1 | | 9/2003 | Bazany | |
| 7,059,272 | B2 | * | 6/2006 | Helou | 119/168 |
| 7,455,215 | B2 | | 11/2008 | McLeod et al. | |
| 7,462,147 | B2 | | 12/2008 | Ludovissie et al. | |
| 7,473,215 | B2 | | 1/2009 | Moen | |
| 7,628,746 | B2 | | 12/2009 | Varanasi | |
| 7,810,707 | B2 | | 10/2010 | Little | |
| 7,935,041 | B2 | | 5/2011 | Graham et al. | |
| 7,976,448 | B2 | | 7/2011 | Jannin et al. | |
| 2004/0094452 | A1 | * | 5/2004 | Scott et al. | 206/769 |
| 2005/0040063 | A1 | * | 2/2005 | Churvis et al. | 206/386 |
| 2008/0245849 | A1 | | 10/2008 | Mathieu et al. | |

OTHER PUBLICATIONS

Non-Final Office Action dated May 29, 2012 in U.S. Appl. No. 12/940,275.

Final Office Action dated Dec. 4, 2014 in U.S. Appl. No. 12/940,275.

* cited by examiner

CORRUGATED CARDBOARD BOX WITH OPEN-WORK FLAPS AND SET OF BLANKS FOR OBTAINING SAME

The present invention relates to a box of generally parallelepipedal form, made of corrugated cardboard sheet, for packaging and transporting objects, said box comprising a lid formed by a lateral band comprising a front wall, a rear wall, side walls and a top, and a tray forming a base comprising a central panel with four main sides, each respectively provided with a first flap.

The invention also relates to a set of blanks for forming such a box.

The present invention is particularly importantly, although non-exclusively, applicable in the field of boxes used to display goods directly on a pallet in superstores and in this way avoid additional intermediate handling and storage costs.

In particular, this type of packaging allows easy and convenient access to the products for the consumer regardless of the position of the box, at least on the two accessible front and rear faces of the pallet.

Devices are already known that allow direct access to products inside packages arranged on a pallet.

Such devices are not satisfactory. In practice, they normally require a part of the walls to be torn to make the products accessible. Furthermore, in the case of open-work trays, the latter do not have any great solidity, so that it is not possible to have heavy products stored on pallets and/or on a large number of levels.

The present invention aims to overcome these drawbacks.

To this end, it essentially proposes a box of generally parallelepipedal form, made of corrugated cardboard sheet, for packaging and transporting objects, said box comprising a lid formed by a lateral band comprising a front wall, a rear wall, side walls and a top, and a tray forming a base comprising a central panel with four main sides, each respectively provided with a first flap, characterized in that the front and rear walls are U-shaped and each define with the top a central opening specifically to enable a user to manually grasp an object inside the box from the side and/or from the top, in that two first flaps facing said tray comprise a tab at each of their lateral ends, respectively fixed to the first adjacent flap to form said tray, and in that at least one of the front, rear or side walls of the lid is only fixed to a first corresponding side flap of the tray, by one or more partially pre-cut portions and/or one or more gluing points enabling separation between walls of the lid and first flaps of the tray by manual separation obtained by exerting a force perpendicularly to the walls.

Such a box allows for the use of cardboard of different grades between the band of side walls and the base. For example, the base can be made of cardboard that is less strong than the walls which have to withstand compression, the base only having to withstand buckling.

With the invention, it will be possible to have access to the goods on the two main faces of the box, to take the products at the front or the back of the pallet. Furthermore, it allows for combined use with or without the display-pack function on a tray separated from its lid.

The consumer can then help himself from all levels of the pallet, either from the trays or through the open-work faces.

With the invention, the products are therefore instantaneously and directly available on the pallet itself, the only operation required to install the assembly being to remove the plastic film used during transportation around the packaging, then, if necessary and as and when required, to remove the lids by simple lateral separation to separate lid and tray.

The packaging according to the invention is perfectly stackable, and this with a good compression resistance. The lid of the box is easily detachable, which allows for the display-pack function either on the pallet itself or on a linear shelf.

In advantageous embodiments, use can be made of one and/or other of the following arrangements:

- the front and rear walls comprise a horizontal stiffening bar located in the middle or roughly in the middle of the corresponding opening, advantageously tearable;
- said partially pre-cut portions or gluing points are at least two in number, respectively located on either side on the side walls of the box;
- the front, rear and side walls are separated from each other by intermediate walls to form an eight-sided box, with cut corners;
- the lid is nested inside the tray;
- the partially pre-cut portion or portions belong to the tray;
- the partially pre-cut portion or portions are pre-cut along an open line;
- the partially pre-cut portion or portions are cut along a closed line;
- the lid comprises at least four panels forming the walls, respectively linked to each other by parallel fold lines and an end gluing tab, and in that the top of the box comprises two second opposing flaps with free platform-configuration longitudinal edge, with U-shaped open-work, of which the ends of the branches are linked to the ends of the branches of the U of the corresponding front and rear walls;
- the second open-work flaps comprise, at their lateral end, counter-pressure overhangs;
- the second flaps comprise, at their lateral end, second tabs glued to the facing side wall;
- the top of the box also comprises third flaps linked to the top edge of the side walls, glued to the second flaps to form said top;
- the lid comprises three panels, namely a central rectangular panel forming the top face of the lid of the box linked laterally by fold lines to two side panels forming at least partly the front and rear walls of the box, said side panels and/or said central panel being provided on either side with four flaps specifically for forming at least partially said side walls;
- each side wall comprises a handle;
- the box also comprises two individual internal reinforcing side panels, specifically for cooperating in contact with the internal face of the side walls and for reinforcing the vertical resistance of said box.

The invention also proposes a set of blanks for forming a box for packaging and transporting objects, comprising at least two corrugated cardboard blanks, namely a first blank specifically for forming the lid of the box, comprising a series of at least four main flaps, namely a front flap, a rear flap and two side flaps, terminated by a fixing tab and linked to each other by first fold lines parallel to each other, said series of flaps forming the external walls of the box and being linked on one side to a series of flaps by second fold lines perpendicular to said first fold lines, said series of flaps being specifically for forming at least partially the top of the box and comprising two second opposing platform-configuration flaps, each linked to the top edge of a corresponding side flap, and a second blank forming the base of said box in the form of a tray, comprising a central panel provided with first flaps on its sides, characterized in that the front and rear flaps are U-shaped and each define with the top a central opening specifically to enable a user to manually grasp an object inside the box from the side and/or from the top, in that two first flaps facing said second blank comprise a tab at each of their lateral ends, respectively intended to be fixed to the first adjacent flap to form said tray, and in that at least one of the front, rear or side walls of the lid is arranged to be only fixed to a first corresponding side flap of the tray, by one or more partially pre-cut portions and/or one or more gluing points enabling separation between walls of the lid and first flaps of the tray by manual separation obtained by exerting a force perpendicularly to the walls.

In an advantageous embodiment, the front and rear panels comprise a central stiffening bar, for example tearable, located in the middle or roughly in the middle of the corresponding opening.

Advantageously, said partially pre-cut portions are at least two in number, respectively located on either side on the side walls of the box.

In an advantageous embodiment, the first flaps of the second blank are arranged to be fixed to said first blank by winding around a volume of determined dimensions on forming the box, before they are finally joined.

Advantageously, the first blank has eight flaps, namely four main flaps separated from each other by intermediate flaps specifically for forming cut corners of the box.

The invention also proposes a method for producing a packaging box of polygonal section from at least two blanks of uncorrugated or corrugated cardboard sheet material, namely a first blank comprising a series of at least four main flaps terminated by a fixing tab, linked to each other by first fold lines parallel to each other, said series of flaps forming the external walls of the box and being linked on one side to a series of flaps by second fold lines perpendicular to said first fold lines, said series of flaps forming the top of said box, and a second blank comprising at least two panels linked to each other by a third fold line, namely a first panel and one or more second panels, said second blank forming the base in the form of a bottom tray for said box, characterized in that the box is formed by winding the blanks around a determined volume, two reinforcing sheets are placed flat on a mandrel that is then inserted into the package to be fabricated to then leave them as reinforcement inside said box by removing said mandrel.

The invention will be better understood from reading the following description of embodiments given below by way of non-limiting examples.

The description refers to the accompanying drawings, in which:

FIG. 1 shows a parallelepipedal box 1, for example made of double-sided corrugated cardboard sheet 3 mm thick for packaging objects (not shown), for example comprising heavy objects such as bottles of household products or canned food.

Figure 1:
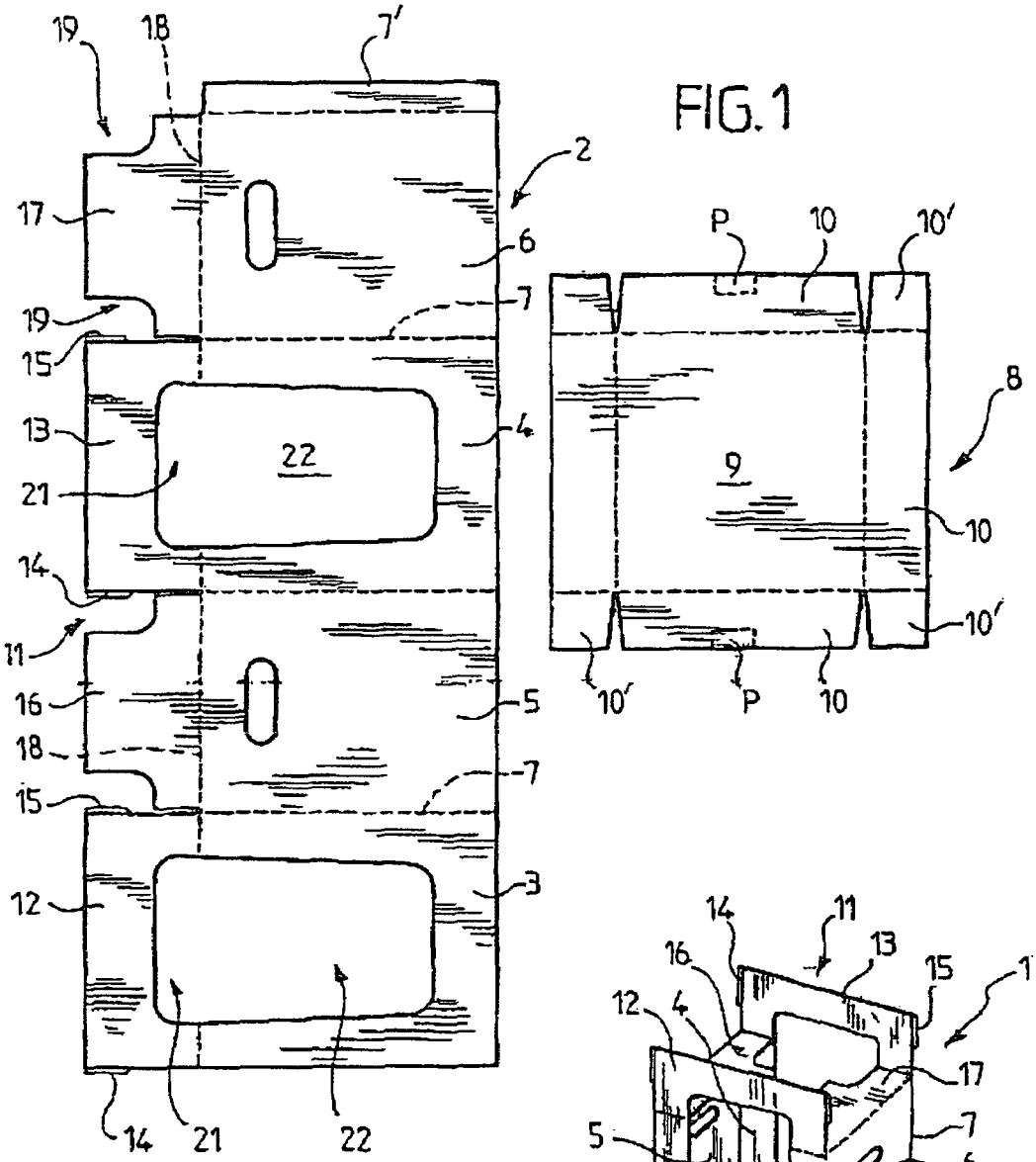
FIG. 1 is a front perspective view of a first embodiment of a box according to the invention.

The box 1 comprises a lateral band 2 of flaps, namely a front flap 3, U-shaped, a rear flap 4, also U-shaped, and two side flaps 5 and 6 that are equal, rectangular, linked to each other by parallel fold lines 7.

It also comprises a base 8 formed by a central panel 9 provided on each of its sides with first rectangular or roughly rectangular flaps 10, including two opposing flaps provided with tabs 10' glued to the external edge of the adjacent flaps to form a rigid tray.

Figure 4:
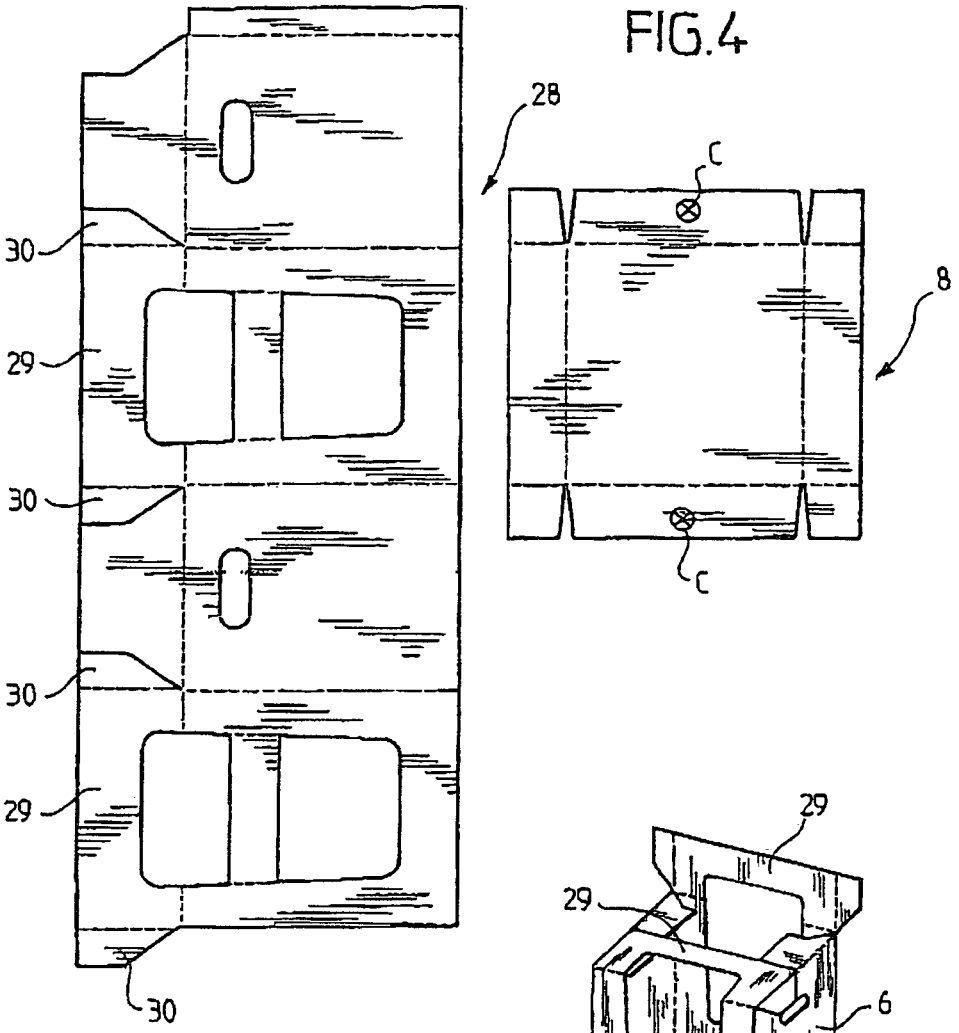
FIG. 4 is a third embodiment of a set of blanks according to the invention.
Figure 5:
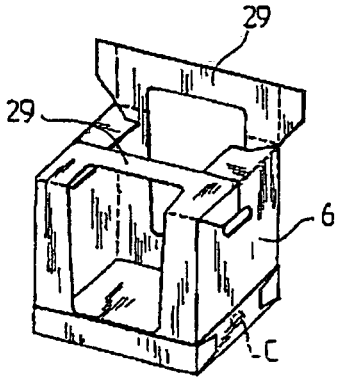
FIG. 5 is a perspective view of the box obtained with the set of FIG. 4.

The tray-forming base is joined to the bottom part of the lid-forming lateral band on either side by a partially pre-cut portion P that is open, and/or by gluing points C shown by broken lines in FIGS. 4 and 5.

This pre-cut part, which alone is glued to the adjacent wall, is therefore easily separable from the lid.

The box comprises a top 11 with two second opposing flaps 12 and 13 forming platforms with openings towards the fold line each provided on their peripheral lateral edges with an overhang or protuberance 14, 15, which will enable the necessary counter-pressure to be exerted to glue said second flaps to the external face of the third flaps.

The top of the box 1 in effect also comprises two third flaps 16, 17 that are roughly T-shaped, the base of which is linked by a fold line 18 to the corresponding side face 5, 6 and which comprises openings 19 on its lateral ends away from the fold line, of rounded shape, on the one hand to enable the second flaps to be folded back on forming the box, and on the other hand to enable the open-work part 20 of the second reversed U-shaped flaps to remain free, the third flaps 16, 17 moreover being glued to the bottom face of the first flaps.

The third flaps 16, 17 have a width less than half the width of the side flaps.

The top of the box is open-work over a part so that it thus comprises two openings 21, a part with the open-work parts 22 of the U of the front 3 and rear 4 flaps, enabling a user to easily grasp by hand, directly inside the box, the structure of which nevertheless allows for the whole to be held rigid.

Figure 2:
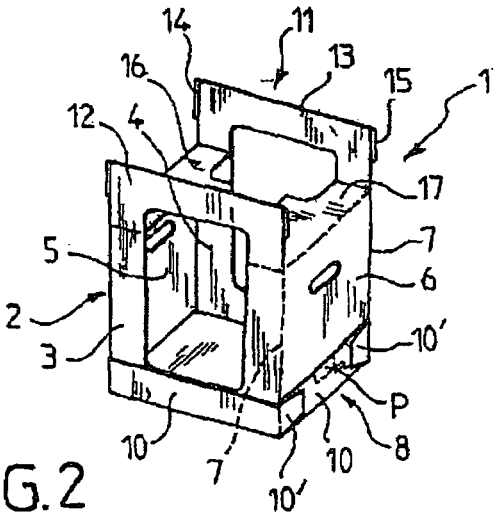
FIG. 2 is a top view of a set of blanks enabling the box of FIG. 1 to be obtained.

FIG. 2 shows the set 2, 8 of blanks used to create the box 1 of FIG. 1. For simplicity in the description hereinbelow, the same reference numbers are used to denote the same elements or similar elements. The lateral band 2 is terminated with a rectangular gluing tab 7' linked to an adjacent side flap 7 by a fold line parallel to those linking the other flaps of the series.

Figure 3:
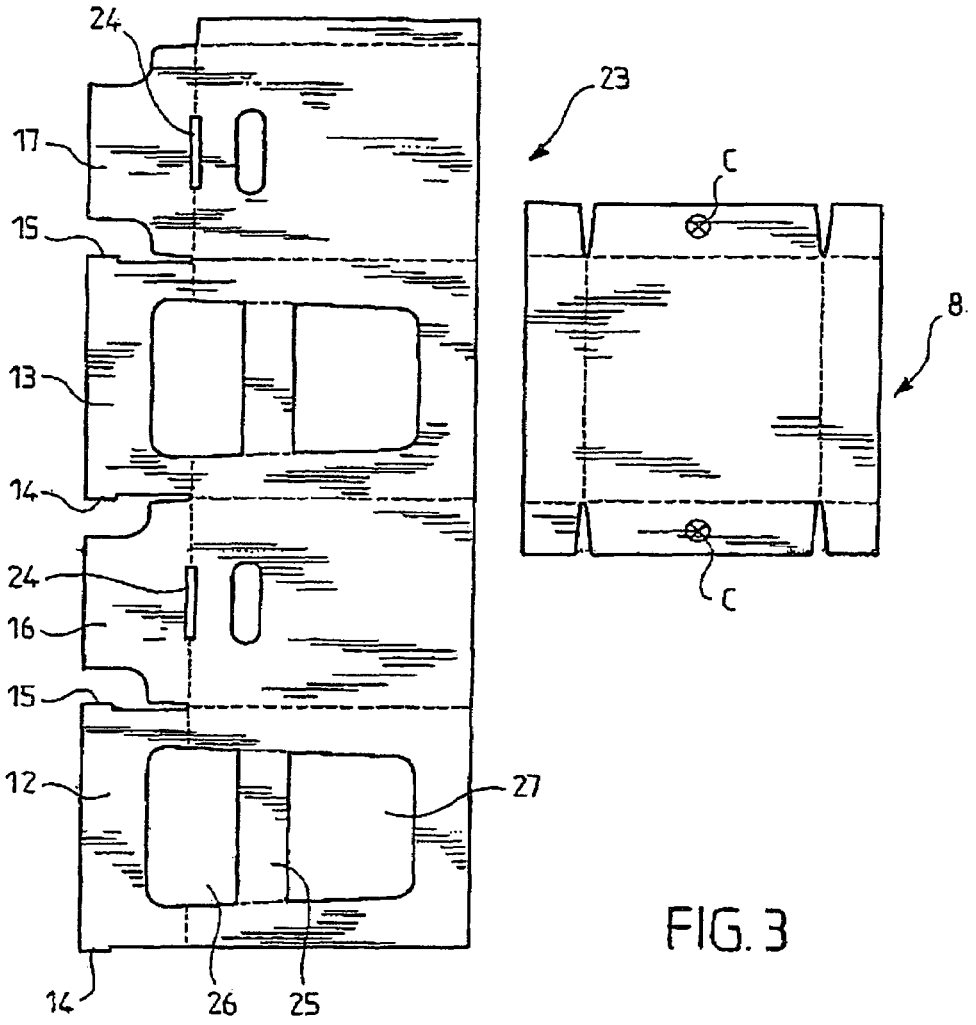
FIG. 3 is another embodiment, in top view, of a set of blanks according to the invention.

FIG. 3 shows a variant 23 of the lateral band of flaps compared to that of FIG. 2, with openings 24 located on the fold line 18, of shapes complementary to the stubs 14, 15, specifically for cooperating with said stubs by snap-fitting.

Horizontal stiffening cardboard strips 25 are here provided in the U-shaped openings, for example at two-thirds or three-quarters of the height of the flap, delimiting a top part 26 of the opening straddling the join line between the front or rear flaps and second flaps 12 and 13 and a bottom part 27 of the opening.

Gluing the third flaps 16, 17 to the second flaps 12, 13 makes it possible to stiffen the assembly and prevent the side faces from twisting.

FIGS. 4 and 5 show another embodiment of a set 28 according to the invention, in which the second flaps 29, of a shape overall identical to the second flaps 12, 13, are prolonged on each side on their lateral edges, with tabs 30, that can be folded towards the adjacent side face 5, 6.

More specifically, these tabs are provided to be return-glued onto the external face of the side flap, making it possible to secure the platforms which will here enable the boxes to be stacked and further enhance their resistance on pallets after partial emptying of the objects.

Figure 6:
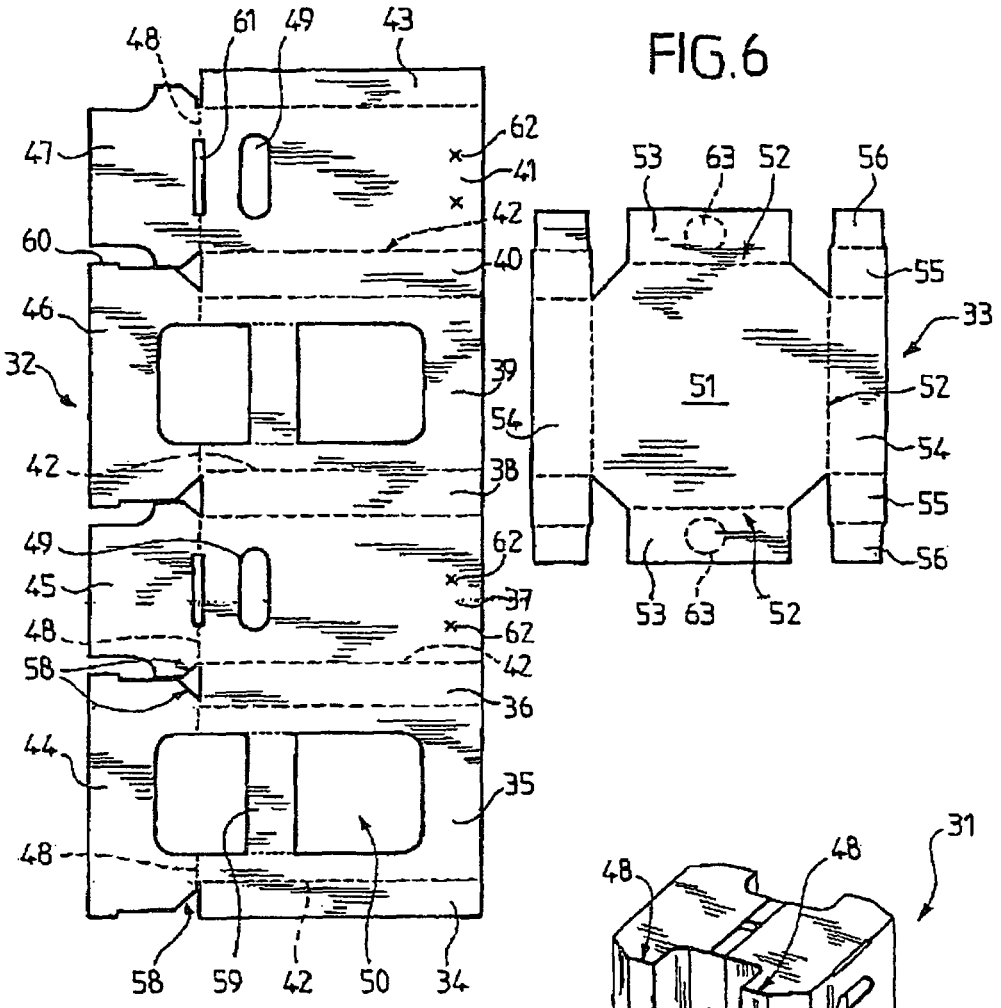
FIG. 6 is a top plan view of a fourth embodiment of a set according to the invention with eight sides.
Figure 7:
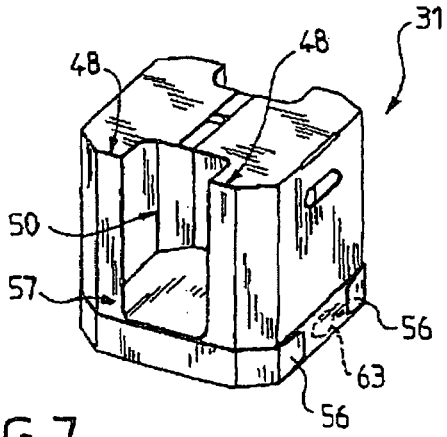
FIG. 7 is a perspective view of a box obtained with the set of FIG. 6.

FIGS. 6 and 7 are front and perspective views of an eight-sided box 31.

FIG. 6 shows, laid flat, a first blank 32 of sheet material for making an eight-sided embodiment of the invention and a second blank 33 for forming the base tray of the box shown in FIG. 7.

More specifically, the blank 32 comprises a series of eight aligned rectangular flaps 34, 35, 36, 37, 38, 40, 41, linked in pairs by preformed, parallel fold lines 42.

Along the free edge of the extreme flap 41 of the series of flaps there is a tab 43 linked to the extreme flaps by a fold line parallel to the above-mentioned fold lines 42.

Moreover, on one side of the series of flaps, first flaps 44, 45, 46, 47 are provided.

Each first flap is hinged to the corresponding main flap by a preformed fold line 48.

These fold lines are aligned or roughly aligned and perpendicular to the fold lines 42.

The rectangular flaps are all of the same height or roughly the same height.

They comprise, on the one-hand, the flaps 37 and 41 intended to form the side walls of the rectangular box, identical to each other, and provided with a handle 49, and the flaps 35 and 39 intended to form the front and rear walls provided with an open-work part 50 straddling the corresponding fold line 48 between said wall and the adjacent flaps 44 and 46, themselves open towards said fold line and intended to form in part the top of the box, and, on the other hand, the intermediate flaps 34, 36, 38 and 40 specifically for forming the cut corners of the lid.

This blank is intended to form, by winding, and after joining the flaps, the box of FIG. 7.

The second blank 33 comprises an octagonal base 51 provided on each of its main sides 52 corresponding to the side and front and rear faces with third paired opposing rectangular flaps 53 and 54, namely two small flaps 53 without lateral tabs, and two larger flaps 54 terminated on either side by first tabs 55, themselves linked to second tabs 56 to mate, when the bottom tray is formed around the bottom part 57 of the second blank (folded on itself to form the lid of the box 31), the cut corners of said tray, the last end tabs 56 being glued to the small adjacent rectangular flaps 53 corresponding to the other two facing sides of the second blank.

The first flaps are generally rectangular, like the flaps 12, 13 and 16, 17 of FIGS. 2 and 3, but also comprise parts 58 slanting towards the outside at their lateral end, on either side, over at least a part, and from fold lines 48 joining with the flaps.

In the embodiment of FIG. 6, there are also provided tabs or horizontal reinforcing strips 59, tearable, in the corresponding openings 50, in the main side faces.

Similarly, as for the blanks of FIG. 3, lateral stubs 60 are provided for snap-fitting in corresponding openings 61 located on the fold lines for connection with the flaps.

According to the invention, provision is also made for joining between the tray and the bottom part of the lid using two spots of glue 62 on at least one of the faces and advantageously on two of the side faces of the package and/or a pre-cut portion 63, for example closed on the flaps 53.

Figure 8:
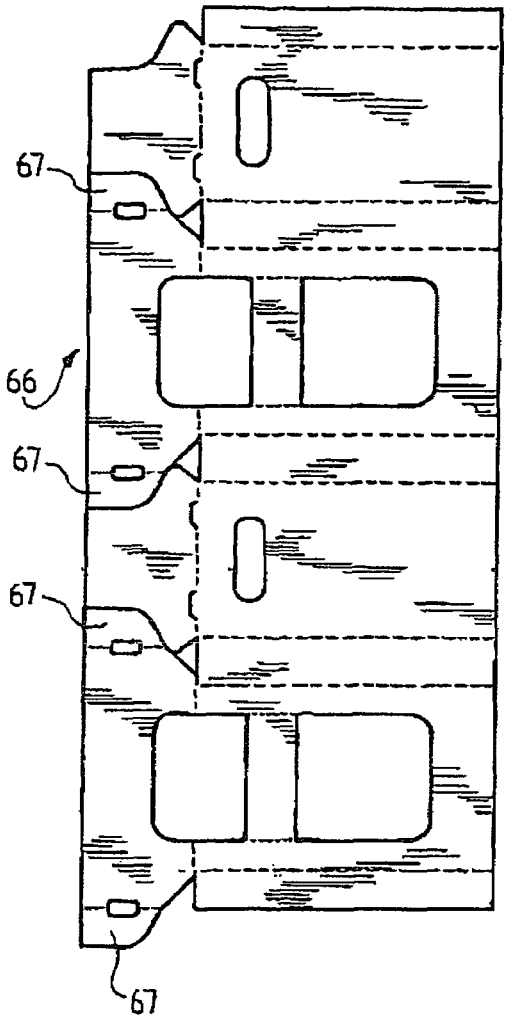
FIGS. 8 and 9 are respectively a plan view of a set of blanks, and a perspective view of the formed box corresponding to a fifth embodiment according to the invention.
Figure 9:
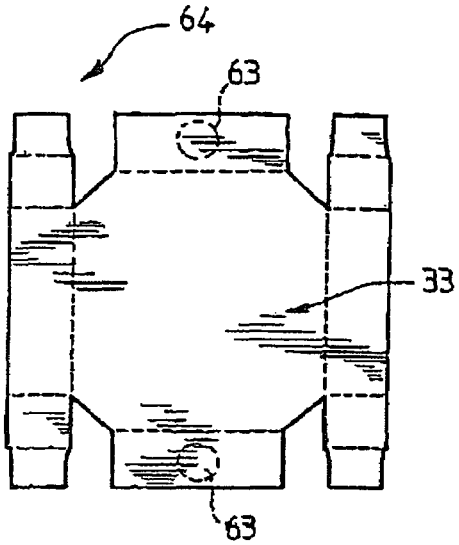
Figure 9:
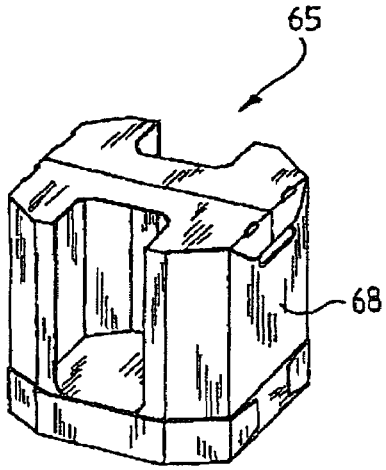

FIGS. 8 and 9 show another embodiment of a set of blanks 64 and a box 65 according to the invention with eight sides.

Here, the embodiment of the first flaps is similar to that of the first flaps 29 with reference to FIGS. 4 and 5, taking into account, of course, the intermediate flaps forming cut corners as described this time with reference to FIG. 6.

Lateral tabs 67 are therefore provided and glued (cf. FIG. 9) to the side walls 68 to stiffen the whole.

Figure 10:
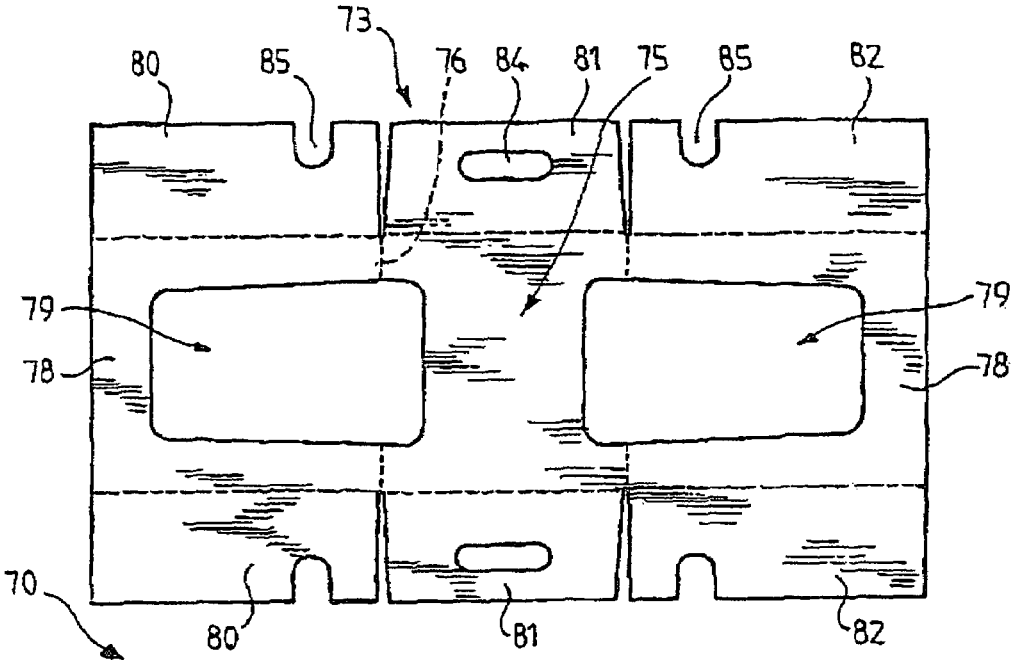
FIGS. 10 and 11 are on the one hand a top plan view of a set and on the other hand a perspective view of the formed box, corresponding to a sixth embodiment.
Figure 11:
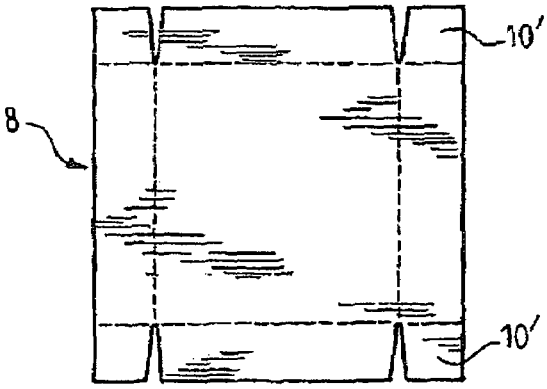
Figure 11:
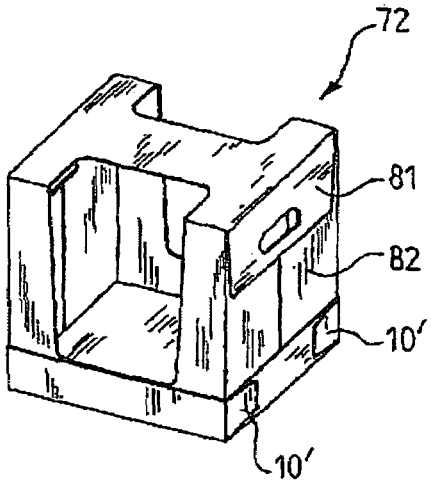
Figure 12:
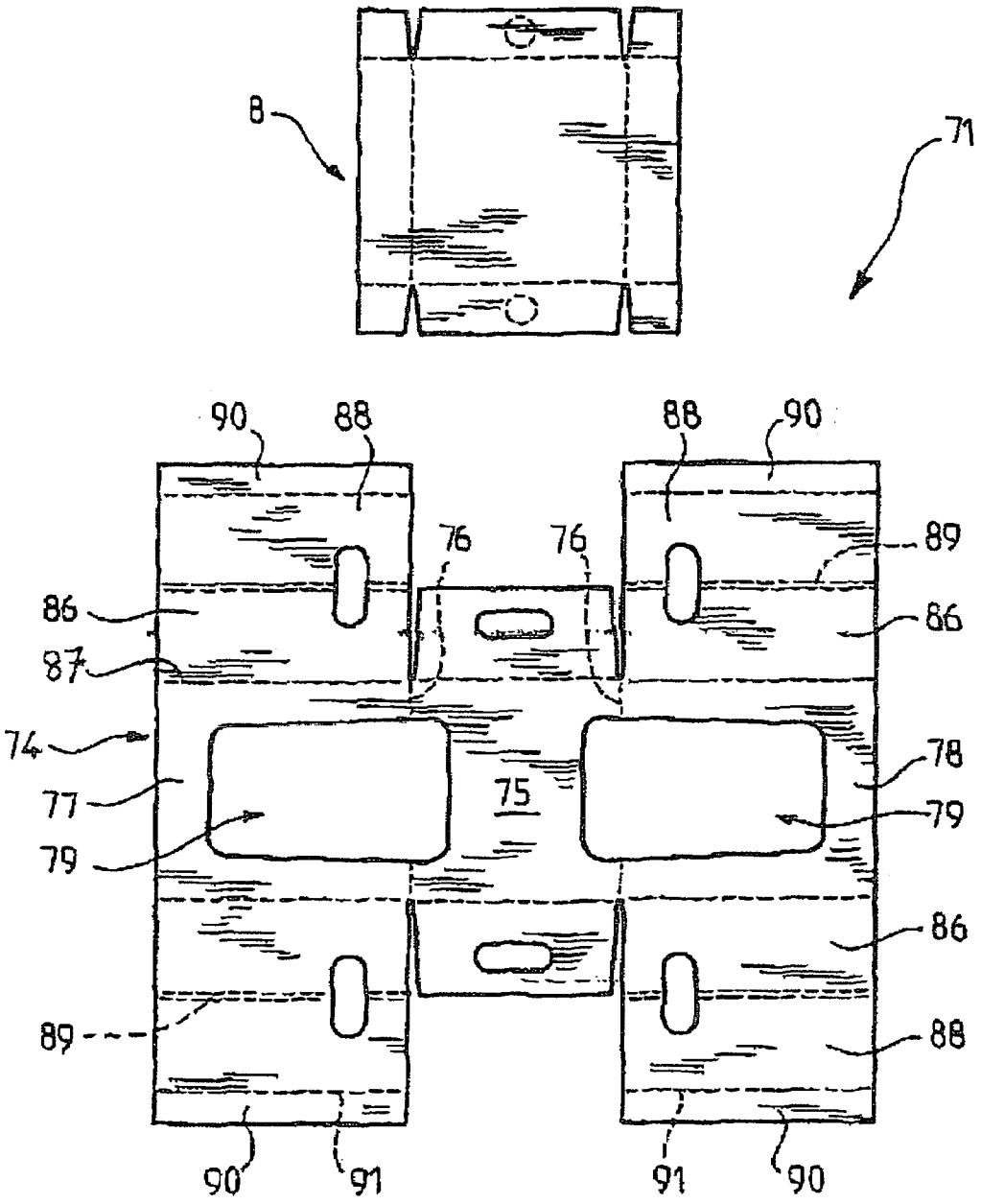
FIG. 12 is a plan view of a seventh embodiment of a set of blanks according to the invention.

FIGS. 10, 11 and 12 show another embodiment of a set 70, 71 of blanks and a box 72 according to the invention, this time comprising a lid or first blank 73, 74 comprising three panels.

More specifically, a rectangular or roughly rectangular central panel 75 is provided, forming the top face of the lid, linked laterally by fold lines 76 to two side panels 77, 78 forming at least partly the front and rear walls of the box, symmetrical relative to the central panel, U-shaped with the bar towards the base of the box, and each respectively provided with a large roughly rectangular opening 79, occupying roughly two-thirds or four-fifths or five-sixths of the area of the panel, partly straddling the fold lines 76, allowing access to the product once the box is formed in accordance with FIG. 11.

The side panels 77, 78 and the central panel 75 are provided on each side with four flaps specifically for forming at least partially the side walls, said four flaps being roughly rectangular or trapezoidal.

More specifically with reference to FIG. 10, the blank 73 comprises two sets of rectangular or roughly rectangular side flaps 80, 81, 82, of the same height, namely a central flap 81 with a handle 84 with opening and two symmetrical flaps 80 and 82 relative to the flap 81, each provided with a notch 85, covering the handle.

The second blank is identical or similar to the blank of FIG. 2.

FIG. 12 shows another embodiment of a blank with three panels, namely a central panel 75 similar to the central panel described with reference to FIG. 10 and two side panels 77 and 78, also identical to the side panels described with reference to FIG. 10, but this time each provided on each side with side flaps in three parts, namely a first flap 86 directly connected by a single fold line 87 to the corresponding side panels 77, 78, a second flap 88 connected to the first flap by a double fold line 89 and a third tab-forming flap 90 connected to the second flap via a last fold line 91 parallel to the first two.

Figure 13:
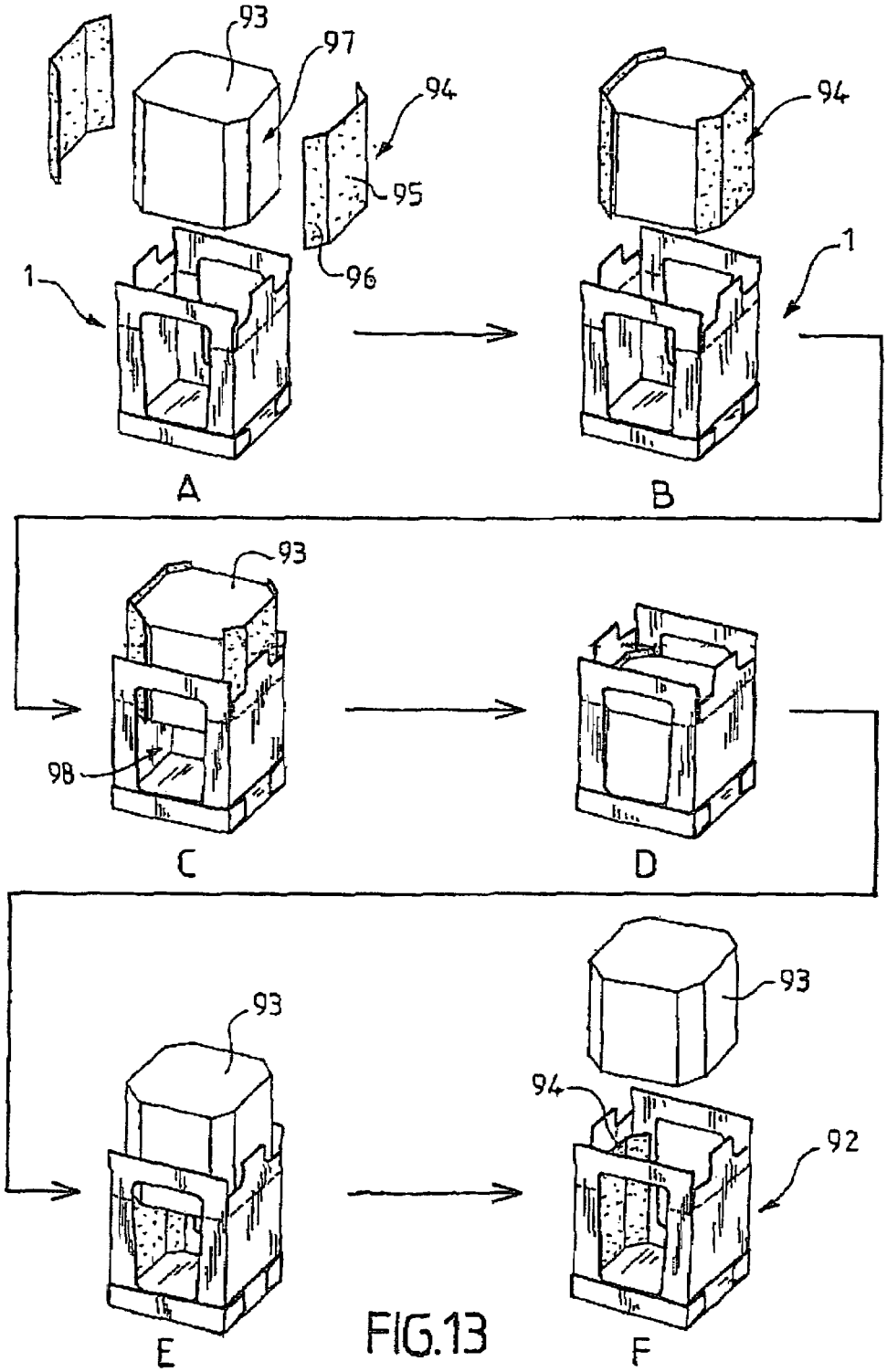
FIG. 13 shows the steps in forming a box with reinforcement by using a mandrel according to one embodiment of the invention.

FIG. 13 shows how a box 92 with reinforcements can be formed according to another embodiment of the invention.

The box is of the type of that described with reference to FIG. 1 and obtained by cladding a first mandrel (not shown) simultaneously with the first and the second blanks.

Firstly (step A), a mandrel 93 of octagonal section with cut corners is offered up, on which there are placed flat (step B), on either side, two panels 94, comprising a central face 95 and two lateral cut corners 96, on the faces 97 of the octagonal mandrel.

The latter, with the panels placed flat on it, is then lowered (step C) inside 98 the parallelepipedal box 1 until it stops at the bottom (step D).

Then, the mandrel is shrunk widthwise in a manner known per se and retracted upwards (step E) so as to obtain in the step F the box 92 with reinforcements 94 inside.

Figure 14:
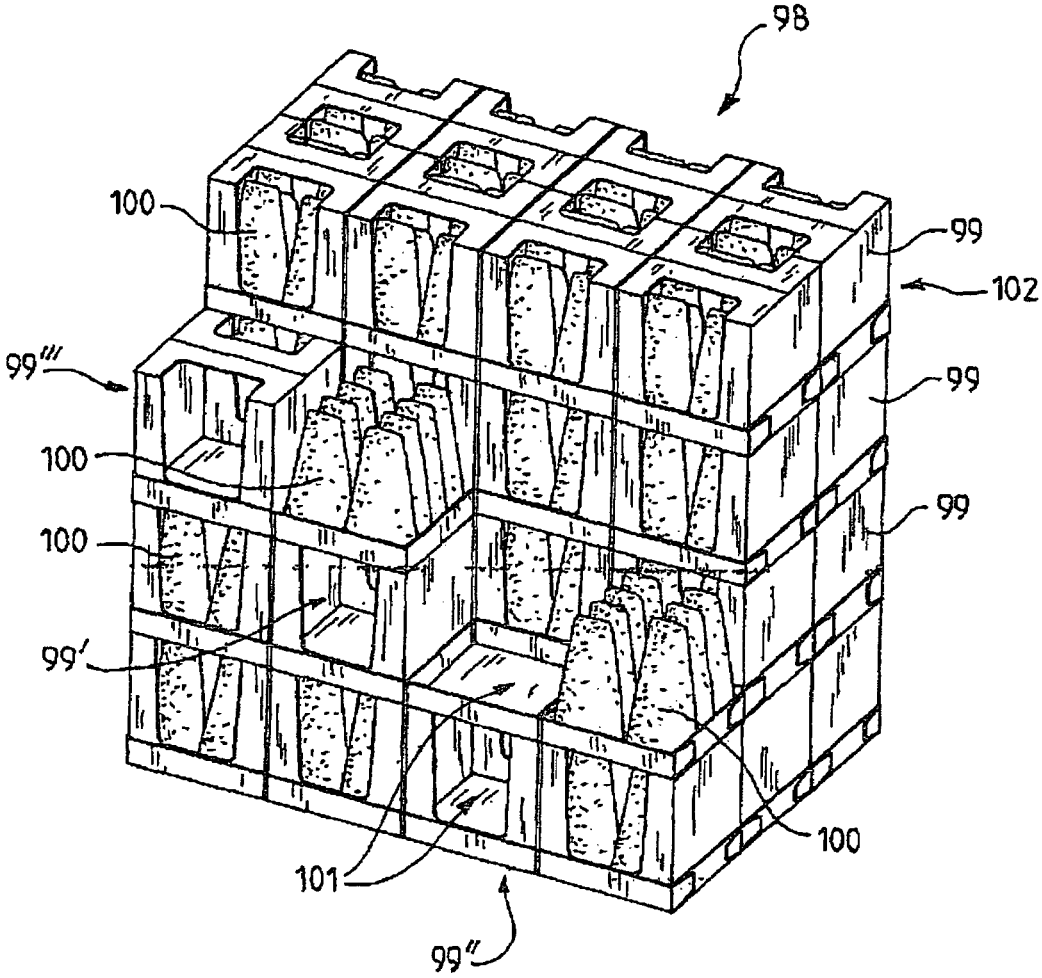
FIG. 14 is a perspective view of a pallet of boxes according to the embodiment of the invention more particularly described here.

FIG. 14 is a perspective view of a pallet 98 of boxes 99 according to the embodiment of FIG. 1 provided with products 100, stacked evenly.

As can be seen, it is possible to remove the products 100 from the bottom part 101, while retaining full boxes in the top part 102.

For example, certain objects have been extracted from the boxes 99', 99", 99'", without in any way destabilizing the pallet which remains solid and agreeable to look at for the consumers.

Thus, it is possible with the invention to assemble a complete pallet of objects or products, to ship them directly to the store and to display the objects or products as delivered to the consumer, without any handling on the packages, that is, without tearing sides, without using cutters or opening flaps.

Formation, filling and closure can easily be mechanized, while allowing for the use of lightweight and recycled papers favoring a rigid structure since, as already specified, because of the two-part package, it is possible to use two types of cardboard, one to withstand compression, the other to withstand buckling of the base.

Obviously, and as a result of the foregoing, the present invention is not limited to the embodiments more particularly described. On the contrary, it encompasses all the variants and in particular those in which the set of blanks comprises three blanks, to form respectively the base, the top of the lid and the side walls of said lid.

The invention claimed is:

1. A box of generally parallelepipedal form made of corrugated cardboard sheet, for packaging and transporting objects, said box comprising:

(i) a lid formed by a first blank, said first blank being formed by a lateral band of four panels respectively linked to each other and a gluing tab by parallel folding lines for respectively forming four walls, said walls including a front wall, a rear wall and two lateral walls, said front and rear walls being U-shaped with two first lateral branches defining between them a central opening said two first lateral branches connected to the corresponding lateral wall by said parallel folding lines, forming four corner piles for the box resistant to crushing, each of said panels being connected on an adjacent side of said parallel folding lines to a corresponding flap to form a top to the box, said top being therefore integral and rigidly connected with the panels of the lid, to form an easy and solid grasp, said flaps comprising two second opposing flaps with free platform configuration edges, with U-shaped open work forming two second lateral branches of which the ends are linked to an end of said second lateral branches respectively of the front and the rear wall, said two second lateral branches forming a top of said corner piles resistant to crushing, and defining with the central opening of said front and rear walls an aperture occupying at least two thirds of an area of one of the panels, sufficient to enable a user to manually grasp and extract objects located in the corners of the box, inside the box through the side and the top of the box, and (ii) a tray formed by a second blank, said second blank forming a base comprising a central panel with four main sides, each respectively provided with a first flap having lateral ends, wherein two of said first flaps opposite to each other comprise a tab at each of their lateral ends, respectively fixed to the corresponding adjacent first flap to form said tray, wherein said box is obtained by cladding said first and second blanks simultaneously on a first mandrel, and wherein at least one of the front, rear or side walls of the lid is only fixed to a first corresponding side flap of the tray, by one or more gluing points enabling easy manual separation of the lid with the corresponding first flaps of the tray by simple manual lateral separation obtained by exerting a force perpendicularly to the corresponding facing wall of the tray to which it is attached, wherein the top of the box and the open panels of the lid form a solid grasp allowing an easy manual removal of the lid from the tray after separation.

2. The box as claimed in claim 1, wherein the front and rear walls comprise a horizontal stiffening bar located in the middle or roughly in the middle of its corresponding central opening.

3. The box as claimed in claim 1, wherein gluing points are at least two in number, respectively located on either side on the side walls of the box.

4. The box as claimed in claim 1, wherein the front rear and side walls are separated from each other by intermediate walls to form an eight-sided box, with cut corners.

5. The box as claimed in claim 1, wherein the lid is nested inside the tray.

6. The box as claimed in claim 1, wherein said second opposing flaps comprise, at their lateral end, counter-pressure overhangs or one or more protuberances which enable necessary counter-pressure to glue said second flaps to the external face of the third flap.

7. The box as claimed in claim 1, wherein the second opposing flaps comprise, at their lateral end, second tabs glued to a facing side wall.

8. The box as claimed in claim 1, wherein said flaps forming the top of the box also comprises third flaps linked to the top edge of the side walls, glued to the second flaps to form said top.

9. The box as claimed in claim 1, wherein each side wall comprises a handle.

10. The box as claimed in claim 1, wherein the box also comprises two individual internal reinforcing side panels, specifically for cooperating in contact with the internal face of a corresponding side wall and for reinforcing the vertical resistance of said box.

11. A set of two blanks for forming a box for packaging and transporting objects, comprising two corrugated cardboard blanks, namely (i) a first blank for forming a lid to the box, said first blank being formed by a lateral band of four panels respectively linked to each other and a gluing tab by parallel folding lines for respectively forming four walls to said box, said walls including a front wall, a rear wall and two lateral walls, said front and rear walls being U-shaped with two first lateral branches defining between them a central opening and arranged so that said two first lateral branches connected to the corresponding lateral wall by said parallel folding lines will form four corner piles for the box when formed, to resist to crushing, each of said panels being arranged to be clad on a mandrel connected on an adjacent side of said parallel folding lines to a corresponding flap to form a top to the box to form an easy and solid grasp when the box is formed, said flaps comprising two second opposing flaps with free platform configuration edges, with U-shaped open work forming two second lateral branches of which the ends are linked to an end of said first lateral branches respectively of the front and the rear wall, to define with the central opening of said front and rear walls an aperture occupying at least two thirds of the area of one of the panels specifically to enable a user to manually grasp objects located in the corners of the box inside the box through the side and the top of the box, and (ii) a second blank for forming a base to the box, said second blank being arranged to form a tray comprising a central panel with four main sides, each respectively provided with a first flap having lateral ends, wherein two of said first flaps opposite to each other comprise a tab at each of their lateral ends, respectively to be fixed to the corresponding adjacent first flap to form said tray, wherein said first and second blanks are arranged to be clad around the mandrel simultaneously before they are finally joined, and wherein at least one of the front, rear or side walls of the lid is arranged to be only fixed to a first corresponding side flap of the tray, by one or more gluing points enabling manual separation of the lid and first flaps of the tray by simple manual lateral separation obtained by exerting a force perpendicularly to the walls, and wherein the top of the box and the open panels of the lid when formed allows a solid grasp for easy manual removal of the lid of the tray after separation.

12. The set as claimed in claim 11, wherein the front and rear panels comprise a central stiffening bar located in the middle or roughly in the middle of the corresponding opening.

13. The set of blanks as claimed in claim 11, wherein the first blank has eight flaps, namely four main flaps separated from each other by intermediate flaps specifically for forming cut corners of the box.

* * * * *

UNITED STATES PATENT AND TRADEMARK OFFICE

CERTIFICATE OF CORRECTION

PATENT NO. : 9,180,996 B2
APPLICATION NO. : 11/922222
DATED : November 10, 2015
INVENTOR(S) : Gerard Mathieu et al.

It is certified that error appears in the above-identified patent and that said Letters Patent is hereby corrected as shown below:

IN THE CLAIMS

In Column 7, Claim 1, Lines 38-39
Please delete "central opening" and insert -- central opening, --.

In Column 8, Claim 11, Line 46
Please delete "blanks, namely" and insert -- blanks, namely: --.

Signed and Sealed this
Twenty-ninth Day of March, 2016

Michelle K. Lee

Michelle K. Lee
*Director of the United States Patent and Trademark Office*